US010765222B2

(12) United States Patent
Murphy

(10) Patent No.: US 10,765,222 B2
(45) Date of Patent: Sep. 8, 2020

(54) BED WITH LIFTABLE MATTRESS AND STORAGE CAVITY

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 727 days.

(21) Appl. No.: 14/692,218

(22) Filed: Apr. 21, 2015

(65) Prior Publication Data

US 2015/0342358 A1 Dec. 3, 2015

Related U.S. Application Data

(60) Provisional application No. 62/005,456, filed on May 30, 2014.

(51) Int. Cl.
*A47C 17/86* (2006.01)
*A61G 7/012* (2006.01)

(52) U.S. Cl.
CPC ..... *A47C 17/86* (2013.01); *A61G 7/012* (2013.01)

(58) Field of Classification Search
CPC ..... A47C 19/202; A47C 19/045; A47C 19/22
USPC ..... 5/412, 207–209
See application file for complete search history.

(56) References Cited

U.S. PATENT DOCUMENTS 5,020,173 A * 6/1991 Dreyer, Jr. ..... A47C 19/045 297/188.1
6,061,852 A * 5/2000 Bathrick ..... A61G 7/015 5/400
6,611,973 B2 * 9/2003 Connell ..... A47C 17/86 16/35 R
7,246,389 B2 * 7/2007 Taguchi ..... A61G 7/001 5/608
2005/0081293 A1 * 4/2005 Connell ..... A47C 17/86 5/308
2008/0289112 A1 * 11/2008 Koorey ..... A47C 19/045 5/658
2010/0205748 A1 * 8/2010 Koorey ..... A47C 19/045 5/658
2010/0223722 A1 * 9/2010 Burnett ..... A47C 17/86 5/11
2013/0019402 A1 * 1/2013 Vervoort ..... A47C 17/86 5/412
2013/0291309 A1 * 11/2013 Koorey ..... A47C 19/045 5/658

* cited by examiner

*Primary Examiner* — Peter M. Cuomo
*Assistant Examiner* — Ifeolu A Adeboyejo
(74) *Attorney, Agent, or Firm* — Myers Bigel, P.A.

(57) ABSTRACT

A bed includes: a foundation; a mattress assembly comprising a mattress and an underlying panel; and a lifting mechanism comprising a series of interconnected pivoting links. The foundation includes a head wall, a foot wall opposed to the head wall, opposed side walls between the head wall and the foot wall, and a floor, the head wall, the foot wall, the side walls and the floor forming at least one storage cavity. The lifting mechanism is mounted to the foundation and the mattress assembly and is configured to move the mattress assembly between a lowered position, in which the mattress assembly is positioned atop the foundation, and a raised position, in which the mattress assembly is positioned above and at least partially laterally of the foundation, such that the storage cavity is accessible.

20 Claims, 2 Drawing Sheets

BED WITH LIFTABLE MATTRESS AND STORAGE CAVITY

RELATED APPLICATION

The present application claims priority from and the benefit of U.S. Provisional Patent Application No. 62/005,456, filed May 30, 2015, the disclosure of which is hereby incorporated herein in its entirety.

FIELD OF THE INVENTION

The present invention relates generally to furniture, and more particularly to beds.

BACKGROUND OF THE INVENTION

It is not uncommon for the space underneath a bed to be used as a storage location for all sorts of household items. However, such space is relatively inconvenient to access, typically requiring one to lie on the floor and reach under the bed. As such, it may be desirable to provide a bed with improved storage capability.

SUMMARY OF THE INVENTION

As a first aspect, embodiments of the invention are directed to a bed, comprising: a foundation; a mattress assembly comprising a mattress and an underlying panel; and a lifting mechanism comprising a series of interconnected pivoting links. The foundation includes a head wall, a foot wall opposed to the head wall, opposed side walls between the head wall and the foot wall, and a floor, the head wall, the foot wall, the side walls and the floor forming at least one storage cavity. The lifting mechanism is mounted to the foundation and the mattress assembly and is configured to move the mattress assembly between a lowered position, in which the mattress assembly is positioned atop the foundation, and a raised position, in which the mattress assembly is positioned above and at least partially laterally of the foundation, such that the storage cavity is accessible.

As a second aspect, embodiments of the invention are directed to a bed, comprising: a foundation including a head wall, a foot wall opposed to the head wall, opposed side walls between the head wall and the foot wall, and a floor, the head wall, the foot wall, the side walls and the floor forming at least one storage cavity; a mattress assembly comprising a mattress and an underlying panel; and a lifting mechanism comprising a series of interconnected pivoting links, the lifting mechanism being mounted to the foundation and the mattress assembly. The lifting mechanism is configured to move the mattress assembly between a lowered position, in which the mattress assembly is positioned atop the foundation, and a raised position, in which the mattress assembly is positioned above and at least partially laterally of the foundation, with one side edge of the mattress being raised between about 26 to 36 inches above an upper edge of one of the side walls of the foundation and between about 12 and 20 inches inboard of the upper edge of the side wall, such that the storage cavity is accessible.

DETAILED DESCRIPTION

Figure 1:
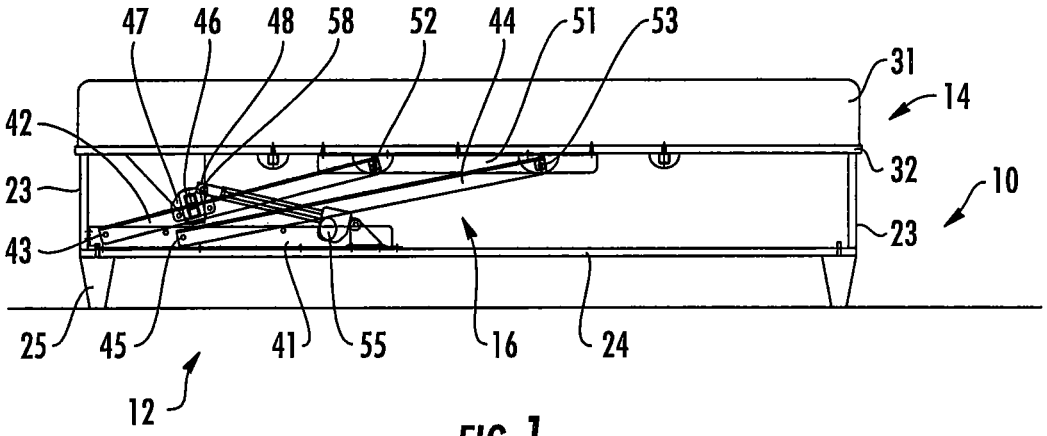
FIG. 1 is an end view of a bed with a liftable mattress according to embodiments of the invention, with the mattress shown in a lowered position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Figure 2:
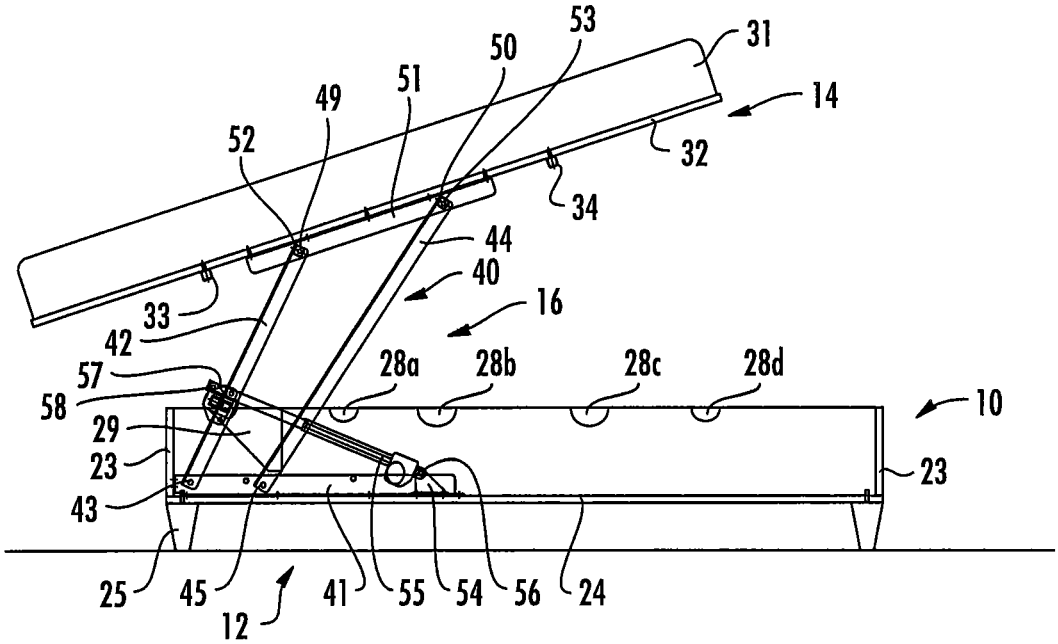
FIG. 2 is an end view of the bed of FIG. 1 with the mattress shown in the raised position.
Figure 3:
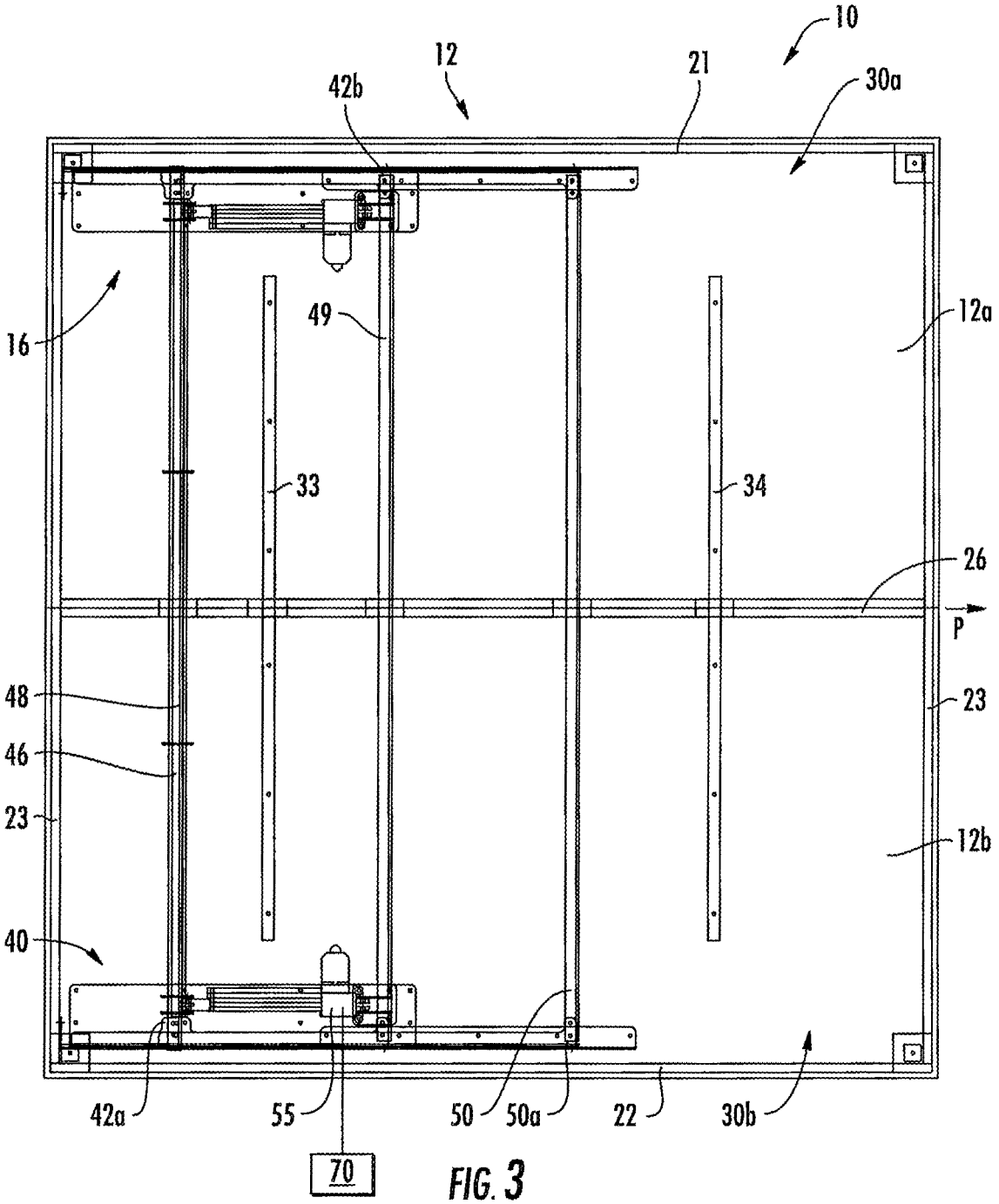
FIG. 3 is a top view of the bed of FIG. 1 with the mattress shown in the lowered position.

Referring now to the figures, a bed, designated broadly at 10, is shown in FIGS. 1-3. The bed 10 includes a foundation 12, a mattress assembly 14, and a lifting unit 16. These components are described in detail below.

The foundation 12 has a generally rectangular footprint and includes a head wall 21, a foot wall 22, opposed side walls 23, and a floor 24. In the illustrated embodiment, the foundation 12 includes feet 25 under the floor 24. Also in the illustrated embodiment, the foundation 12 is formed as two halves 12*a*, 12*b* that are fixed at their side edges, such that a double wall 26 is formed in the center of the foundation 12. Four cutouts 28*a*-28*d* are present in the top edges of the double wall 26, as is a large notch 29. The walls 21, 22, 23, 26 form two storage cavities 30*a*, 30*b*.

In some embodiments, a headboard and/or a footboard may be attached to the appropriate head or foot wall 21, 22 if such a style is desired. Also, the foundation 12 may be configured such that only a single storage cavity is formed, or such that more than two storage cavities are formed. In addition, the foundation 12 may be non-rectangular in shape (e.g., square, trapezoidal, pentagonal, octagonal, etc.) and still be suitable for use with this invention.

The mattress assembly 14 includes a mattress 31, which may be any mattress that is typically employed for bedding. A panel 32 underlies the mattress 31 and supports it from underneath. The panel 32 is large enough to rest upon at least some of the upper edges of the walls of the foundation 12 (see FIGS. 1 and 3). Two longitudinally-extending members 33, 34 are mounted to the underside of the panel 32, and extend into cutouts 28*a*, 28*d* in the double wall 26 of the foundation 12 (see FIG. 3).

The movement of the mattress assembly 14 relative to the foundation 12 is controlled by the lifting unit 16, which will be described in greater detail below. The lifting unit 16 includes two lifting mechanisms 40 that are mirror images of each other about a vertical plane P (FIG. 3) that bisects the bed 10 normal to the head wall 21; as such, only one lifting mechanism 40 will be described herein, with the understanding that the description is applicable to the other mechanism also.

Each lifting mechanism 40 includes a L-shaped bracket 41 mounted to the floor 24. A lateral swing link 42 is mounted to the vertical flange of the bracket 41 at a pivot 43 near one of the side walls 23. A cross-member 46 extends between the two lateral swing links 44 via a bracket 47. Another cross-member 48 is mounted to and extends between the undersides of tabs 42*a* of the lateral swing links 42. A third cross-member 49 extends between tabs 42*b* at the upper ends of the lateral swing links 42. An inboard swing link 44 is mounted to the vertical flange of the bracket 41 at a pivot 45. A cross-member 50 extends between tabs 50*a* at the upper ends of the inboard swing links 44. A second L-shaped bracket 51 is mounted beneath the panel 32. Each lateral swing link 42 is mounted to the vertical flange of the bracket 51 at a pivot 52, and each inboard swing link 44 is mounted to the vertical flange of the bracket 51 at a pivot 53.

An actuator mounting bracket 54 is mounted to the horizontal flange of the bracket 41. A linear actuator 55 (or other power unit) is mounted at one end to the actuator mounting bracket 50 at a pivot 56. The opposite end of the linear actuator 55 is mounted to a bracket 57 fixed to the cross-member 48 at a pivot 58. The linear actuator 55 is typically electrically powered, either via battery or wall outlet, and may be connected to a switch or other activation device 70 (FIG. that is remote and/or detachable from the linear actuator 55 when not in use.

As can be seen in FIG. 1, in the lowered position, each of the lateral and inboard swing links 42, 44 is rotated about its respective pivot 43, 45 to a generally horizontal position, such that the panel 32 of the mattress assembly rests on the rim 27 of the foundation 12. The linear actuator 55 is in its retracted position. The members 33, 34 of the mattress assembly are positioned within the cutouts 28*a*, 28*d* in the double wall 26, the cross-members 49, 50 are positioned within the cutouts 28*b*, 28*c*, and the cross-members 46, 48 are positioned in the notch 29.

Activation of the linear actuator 55 causes it to extend. Extension of the linear actuator 55 forces the cross-member 48, and in turn the lateral swing link 42, to rotate (counter-clockwise from the vantage point of FIGS. 1 and 2) about the pivot 43. Rotation of the lateral swing link 42 forces the panel 32 upwardly and laterally; this movement is controlled by the inboard swing link 44, which rotates counterclockwise about the pivot 45. Movement continues until the panel 32 and mattress 31 reach the raised position shown in FIG. 2. In the illustrated raised position, the panel 32 and mattress 31 are disposed at an oblique angle (typically between about 1 and 25 degrees to horizontal, and in some embodiments between about 10 and 25 degrees to horizontal), and the side edge of the panel 32 and/or the side edge of the mattress 31 are between about 26 to 36 inches above and between about 12 to 20 inches inboard of the upper edge of the side wall 23.

The bed 10 can be returned to the lowered position of FIGS. 1 and 3 by activating the linear actuator 55 to retract. The lateral and inboard swing links 42, 44 pivot clockwise around their respective pivots 43, 45 to lower the mattress assembly 14 until it rests upon the rim 27 of the foundation 12.

The ability of the bed 10 to move the mattress assembly 14 to the raised position of FIG. 2 enables the foundation 12 to serve as a storage receptacle. As discussed above, it is not uncommon for the space underneath a bed to be used as a storage location for all sorts of household items. However, such space is relatively inconvenient to access, typically requiring one to lie on the floor and reach under the bed. The storage cavities 30*a*, 30*b* of the bed 10 can be accessed by simply activating the actuator 55 to move the bed 10 to the raised position. As such, the foundation 12 can provide easily accessed storage. The lateral movement of the mattress assembly 14 relative to the foundation 12 provides additional room for one to access the storage cavities 30*a*, 30*b*.

In addition, when the mattress assembly 14 is in the lowered position, the retracted actuator 55 acts as a locking mechanism that maintains the mattress assembly 14 in the lowered position. As such, the storage space within the foundation 12 is safe from unwanted entry, thereby making items stored therein much more secure than items simply stored under a bed.

As noted above, in some embodiments, a detachable remote device 70 may be employed to activate the linear actuator 55. Such a remote device 70 may be disconnected from the linear actuator 55 when not in use and connected to the actuator 55 only for raising and lowering of the mattress assembly 14. The ability to store the activation device 70 remotely from the linear actuator 55 provides an additional layer of security for items stored within the bed 10.

Also, the movement of the mattress assembly 14 laterally (rather than head to foot) may be advantageous due to typical furniture arrangements and styles. Ordinarily, the head of a bed is positioned against a wall; thus, movement of the mattress assembly toward the head end of the bed would be impeded by such a wall. If the mattress assembly were to move toward the foot end of the bed, the wall adjacent the headboard may prevent a user from being positioned at the head end of the bed to access the storage cavity, thereby eliminating the position where the user has the most room to maneuver. By configuring the bed 10 such that the mattress assembly 14 moves laterally, these issues can be avoided.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A bed, comprising:

a foundation including a head wall, a foot wall opposed to the head wall, opposed side walls between the head wall and the foot wall, and a floor, the head wall, the foot wall, the side walls and the floor forming at least one storage cavity;

a mattress assembly comprising a mattress and an underlying panel; and a lifting mechanism comprising a series of interconnected pivoting links, the lifting mechanism being mounted to the foundation and the mattress assembly, the lifting mechanism configured to move the mattress assembly between a lowered position, in which the mattress assembly is positioned atop the foundation, and a raised position, in which the mattress assembly is positioned above and at least partially laterally of the foundation, such that the storage cavity is accessible.

2. The bed defined in claim 1, wherein the lifting mechanism includes an automated power unit.

3. The bed defined in claim 2, wherein the automated power unit includes a detachable activation unit.

4. The bed defined in claim 1, wherein the lifting mechanism includes a lateral swing link pivotally connected with the foundation and the mattress assembly and an inboard swing link pivotally connected with the foundation and the mattress assembly.

5. The bed defined in claim 1, wherein the foundation includes at least two storage cavities.

6. The bed defined in claim 1, further comprising a headboard attached to the head wall.

7. The bed defined in claim 1, wherein the bed is positioned with the head wall adjacent a wall of a room.

8. The bed defined in claim 1, wherein the mattress is sized to be a king-sized, queen-sized or double mattress.

9. The bed defined in claim 1, wherein in the raised position, the mattress forms an angle with horizontal of between about 1 and 25 degrees.

10. The bed defined in claim 1, wherein in the raised position, one side edge of the mattress is raised between about 26 to 36 inches above an upper edge of one of the side walls of the foundation.

11. The bed defined in claim 1, wherein in the raised position, one side edge of the mattress is position between about 12 and 20 inches inboard of an upper edge of one of the side walls of the foundation.

12. A bed, comprising:

a foundation including a head wall, a foot wall opposed to the head wall, opposed side walls between the head wall and the foot wall, and a floor, the head wall, the foot wall, the side walls and the floor forming at least one storage cavity;

a mattress assembly comprising a mattress and an underlying panel; and a lifting mechanism comprising a series of interconnected pivoting links, the lifting mechanism being mounted to the foundation and the mattress assembly, the lifting mechanism configured to move the mattress assembly between a lowered position, in which the mattress assembly is positioned atop the foundation, and a raised position, in which the mattress assembly is positioned above and at least partially laterally of the foundation, with one side edge of the mattress being raised between about 26 to 36 inches above an upper edge of one of the side walls of the foundation and between about 12 and 20 inches inboard of the upper edge of the side wall, such that the storage cavity is accessible.

13. The bed defined in claim 12, wherein the lifting mechanism includes an automated power unit.

14. The bed defined in claim 13, wherein the automated power unit includes a detachable activation unit.

15. The bed defined in claim 12, wherein the lifting mechanism includes a lateral swing link pivotally connected with the foundation and the mattress assembly and an inboard swing link pivotally connected with the foundation and the mattress assembly.

16. The bed defined in claim 12, wherein the foundation includes at least two storage cavities.

17. The bed defined in claim 12, further comprising a headboard attached to the head wall.

18. The bed defined in claim 12, wherein the bed is positioned with the head wall adjacent a wall of a room.

19. The bed defined in claim 12, wherein the mattress is sized to be a king-sized, queen-sized or double mattress.

20. The bed defined in claim 12, wherein in the raised position, the mattress forms an angle with horizontal of between about 1 and 25 degrees.

* * * * *